United States Patent [19]

LeBeau

[11] Patent Number: 4,880,125

[45] Date of Patent: Nov. 14, 1989

[54] ANTI-BURP NURSING BOTTLE COMBINATION

[76] Inventor: Phil E. LeBeau, Rte. 5, Dexter, Mo. 63841

[21] Appl. No.: 184,429

[22] Filed: Apr. 21, 1988

[51] Int. Cl.[4] ..... A61J 9/00

[52] U.S. Cl. ..... 215/11.3; 222/95; 222/326

[58] Field of Search ..... 222/105, 490, 95, 326; 215/11.3, 11.1; 92/222

[56] References Cited

U.S. PATENT DOCUMENTS

| | | | |
|---|---|---|---|
| 3,157,303 | 11/1964 | Siegel | 215/11.1 |
| 3,161,311 | 12/1964 | Boston | 215/11.3 |
| 3,342,365 | 9/1967 | Lux et al. | 215/11.1 |
| 3,648,873 | 3/1972 | Grobbel | 215/11.3 |
| 3,931,886 | 1/1976 | Yamauchi | 215/11.1 |
| 3,998,348 | 12/1976 | Sammaritano | 215/11.3 |
| 4,176,754 | 12/1979 | Miller | 215/11.3 |
| 4,700,856 | 10/1987 | Campbell et al. | 215/11.3 |
| 4,796,767 | 1/1989 | McKeown | 215/11.3 |

*Primary Examiner*—Andres Kashnikow
*Assistant Examiner*—Karen B. Merritt
*Attorney, Agent, or Firm*—Haverstock, Garrett and Roberts

[57] ABSTRACT

The present invention relates to an anti-burp nursing bottle combination which includes an open ended shell adapted for containing a collapsible liquid container therein and a nipple on the upper end of the open ended shell in open communication with the collapsible liquid container and held in place with a ring and a plunger adapted to fit in mating relationship with the lower end of the open ended shell and adapted to be pushed against the lower portion of the collapsible liquid container in order to force air out through the opening in the nipple.

4 Claims, 1 Drawing Sheet

ANTI-BURP NURSING BOTTLE COMBINATION

FIELD OF THE INVENTION

The present invention relates to an improved nursing bottle combination adapted for holding a collapsible liquid container therein.

More particularly, the present invention relates to a nursing bottle combination which includes an open ended shell adapted for containing a collapsible liquid container therein, a nipple on the upper end of the open ended shell in open communication with the collapsible liquid container and a plunger adapted to fit in mating relationship with the lower end of the open ended shell.

DESCRIPTION OF THE PRIOR ART

In the prior art, various types of cylindrical bottles have been provided for holding therein collapsible liquid containers. Bottles are also shown having means for forcing air from a collapsible liquid container through a nipple element fitted over the upper open end of the container.

Hammer U.S. Pat. No. 3,955,698 discloses a nursing bottle comprising a tubular housing having a built-in spring biased movable support member for collapsing empty portions of the collapsible liquid container against its liquid contents toward the nipple, dispelling any air therein.

Duerme U.S. Pat. No. 3,243,069 and Coen U.S. Pat. No. 4,339,046 also disclose nursing bottles with built-in means for releasing air trapped within the bottle.

The prior art devices are relatively heavy and combersome to use. The present invention overcomes the disadvantages and shortcomings of the prior art devices and in addition is inexpensive and easy to use.

SUMMARY OF THE INVENTION

The present invention relates to an anti-burp nursing bottle combination which includes an open ended bottle shell adapted to retain a disposable collapsible liquid container in the upper portion thereof. A ring which encircles the top of the shell is adapted to hold the liquid container in place and adapted to retain a nipple in place on top of the shell in open communication with and in sealing relation with the liquid container. The lower portion of the shell is adapted to accept a plunger in mating relationship with the open ended shell. As the plunger is moved upward against the lower portion of the liquid container air trapped within the collapsible disposable liquid container is forced out through the nipple. This eliminates air from the liquid container and thus prevents air from entering the user's stomach while nursing.

The subject device is an inexpensive easy-to-use anti-burp nursing bottle combination. Some of the advantages of the present combination are that the nursing bottle can be used with one hand and it does not need to be sterilized.

The nursing bottle combination includes a plunger which may have a base member which provides stability and allows the nursing bottle combination to stand upright. The plunger has an elongated body member, or trunk, with two distinct regions, an upper region made of a soft somewhat flexible material to prevent puncturing of the liquid container inside the nursing bottle while removing the air, and a lower region made of a stiff material for strength and stability.

The nursing bottle combination is used by placing the plunger on a flat surface such as a table top with the trunk portion pointing upward. Then, holding the nursing bottle with the nipple upward in one hand, the open lower end of the nursing bottle shell is slowly lowered onto the plunger until all air in the liquid container is dispelled through the nipple. After the air is expelled the opening in the nipple closes with a resultant partial vacuum being created inside the liquid container which along with atmospheric pressure prevents air from reentering the partially collapsed liquid container. Removing the nursing bottle allows easy feeding of the baby with practically no air present to cause discomfort.

The present invention overcomes many of the shortcomings of the previously known devices in providing a means to remove air trapped within nursing bottles.

It is therefore a principle object of the present invention to provide an inexpensive nursing bottle combination whereby air is removed from a disposable liquid container.

Another object is to provide a nursing bottle combination which does not require sterilization before use.

Another object is to provide a nursing bottle combination which requires only one hand to use.

A further object is to provide a nursing bottle combination having an open ended shell adapted to retain a collapsible liquid container in the upper portion, a nipple in communication with the liquid container and a plunger in mating relation with the lower end of the shell.

These and other objects and advantages of the present invention will become apparent after considering the following detailed specification which covers the preferred embodiment of the subject nursing bottle combination in conjunction with the accompanying drawings. The detailed specification and drawings are to be regarded as illustrative and not as restrictive.

DESCRIPTION OF THE PREFERRED EMBODIMENT

Figure 1:
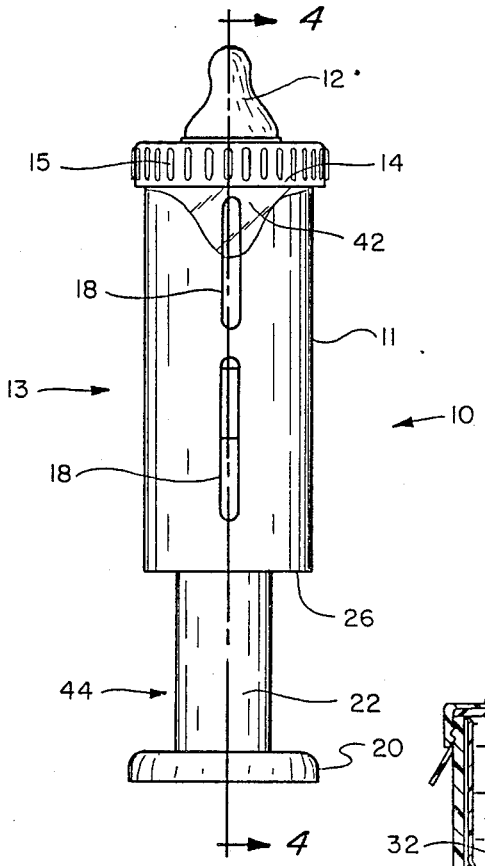
FIG. 1 is a front elevational view of the present invention.

In the drawings like numbers are used to show the same parts in the several figures.

Figure 2:
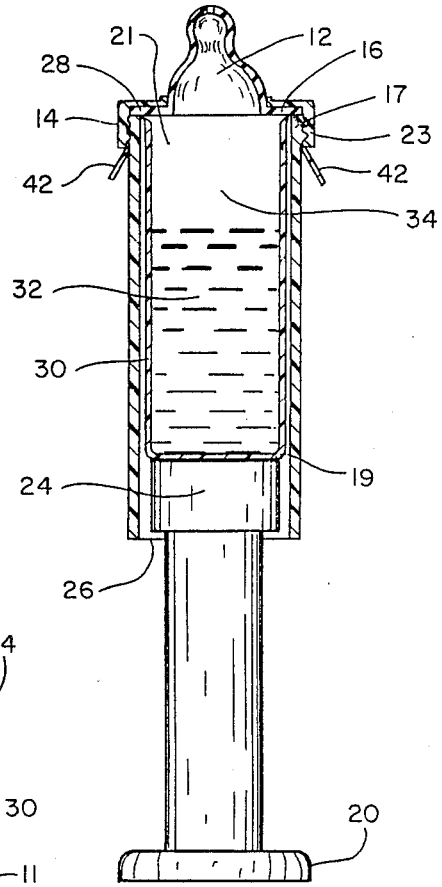
FIG. 2 is a cross-sectional view of the present invention.

Referring now in detail to the drawings and more particularly to FIGS. 1 and 2, therein illustrated is an anti-burp nursing bottle combination 10 embodying the present invention. The anti-burp nursing bottle combination 10 is comprised of five primary parts: nipple 12, clamping ring 14, tubular shell 11, liquid container 30 and plunger 44.

The bottle portion 13 of the present invention is assembled for use by inserting a standard disposable, collaspible, clear plastic liquid container 30 having a sealed bottom end 19 and an open upper end 21 into the top end 28 of the tubular shell 11. The marginal edge tabs 42 of liquid container 30 are folded outwardly and downwardly over the edge of top end 28 covering the external thread 17 thereof.

Holding the marginal edge tabs 42 in place, the liquid 32 is poured into liquid container 30. The proper amount of liquid 32 may be determined by monitoring the liquid level through the graduated slots 18 in plastic tubular shell 11.

Conventional nipple 12, made of a flexible rubbery material, is placed so that the resilient lip portion 16 of nipple 12 rests on top end 28 of tubular shell 11.

Clamping ring 14 has an internally-threaded surface 23 which when placed on top of shell 11 allows nipple 12 to pass through the open center thereof. With a simple twisting motion of clamping ring 14 using the spaced-apart finger grip ridges 15, the internally-threaded surface 23 of the clamping ring 14 and the external threads 17 of shell 11 securely lock and seal the liquid container 30 and nipple 12 in an air-tight and leak-proof fashion.

Inevitably, upon locking all parts in place with clamping ring 14, air 34 is trapped within liquid container 30. If not removed, air 34 enters the user's stomach when feeding. This causes the user much discomfort, including gas and possibly some regurgitation.

Figure 3:
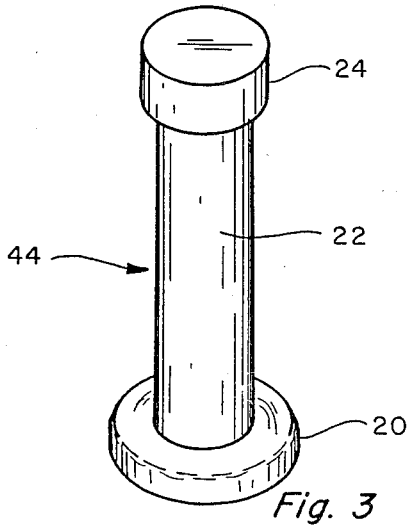
FIG. 3 is a perspective view of the plunger portion of the present invention.

The plunger portion 44 of the present invention is inserted into the open lower end 26 of tubular shell 11. As shown in FIG. 3, plunger portion 44 has three main parts: base 20, trunk 22, and crown 24, each having a specialized function.

Figure 4:
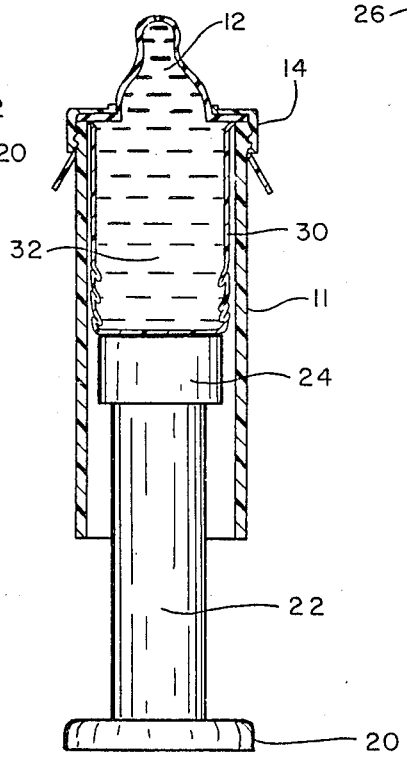
FIG. 4 is a cross-sectional view taken along line 4—4 of FIG. 1.

Base 20 provides stability and may be any configuration. A preferred base 20 is disk-shaped with a diameter significantly larger than that of trunk 22. This is important to provide stability to the plunger when pressure is applied by forcing the bottle portion 13 downward as shown in FIG. 4 and to enable the plunger 44 to stand upright unaided. In the preferred embodiment, base 20 is cylindrical and has approximately a three inch diameter and approximately one-half inch thickness.

Trunk 22 may be of any cross section configuration but is preferably cylindrical in shape and in the preferred embodiment has a diameter of approximately one and a half inches and a height of about five inches. Trunk 22 will be smaller than the open lower end 26 of shell 11. Trunk 22 extends upright in the center of base 20. Base 20 and trunk 22 may be made in one piece or they may be separate. Many different means of fastening trunk 22 and base 20 are possible, such as adhesives, staples, nails, or screws.

Attached to the top of trunk 22 is crown 24. Crown 24 is cylindrically shaped and adapted to mate with opening 26 in bottle portion 13. The diameter will be generally about two inches. The thickness or height will be sufficient to provide some rigidity and will be generally about one half to one and a half to two inches in the preferred embodiment.

Crown 24 is made of a relatively soft but rigid foamed plastic material which prevents puncturing of liquid container 30 upon insertion of plunger 44 into shell 11. The foamed plastic may be any somewhat flexible but reasonably rigid foamed material such as polystyrene, polyvinyl chloride, polyethylene, polypropylene, styrene-butadiene rubber or natural rubber. The preferred foamed plastic is foamed polystyrene.

Crown 24 may be attached to the top of trunk 22 in any conventional manner. It will be generally adhesively joined.

Alternatively, plunger 44 may be made from one piece such as a molded rigid plastic material with only the upper surface of crown 24 having a foamed plastic surface. The size of crown 24 is significant in that the approximately two inch diameter is just slightly smaller than the diameter of standard sized nursing bottle portion 13. This allows the plunger 44 to be pushed up against the bottom of liquid container 30 without portions of the liquid container 30 slipping down around the sides of crown 24.

As plunger 44 is pushed against the bottom of liquid container 30, unwanted trapped air 34 is displaced from liquid container 30. Removal of air 34 is achieved by standing the plunger 44 upright on its base 20 on a flat surface such as a table top or kitchen counter. Shell 11 with liquid container 30 in place is gently pushed downwardly onto plunger 44 until air 34 is dispelled outwardly through nipple 12 as shown in FIG. 4. When drops of liquid appear coming out of the nipple, essentially all air has been removed and nursing bottle 11, if desired, may be removed from the plunger 44 before feeding. Due to atmospheric pressure and the vacuum created within liquid container 30, air will not reenter the container.

It is furhter to be especially noted that although the plunger portion of the present invention may be made from many different materials, the base 20 and trunk 22 of the preferred embodiment are made from woodo while the crown 24 is made of foamed polystyrene. One possible variation of the plunger portion 44 would be to have all three parts, base 20, trunk 22 and crown 24 molded from plastic having crown 24 made of a relatively flexible plastic while trunk 22 and base 20 are formed from a relatively rigid plastic.

Although but one specific embodiment of the present invention is shown and described, it is understood that details of construction shown may be altered or omitted without departing from the spirit or scope of the present invention as defined by the following claims.

What is claimed is:

1. An anti-burp nursing bottle combination comprising an open ended bottle shell adapted to retain a disposable collapsible liquid container held in place by a ring encircling the top of said shell, said ring retaining a nipple in place on top of said shell in sealing relationship with said liquid container, said open ended bottle shell being adapted to accept a plunger in the open lower end of said bottle shell in mating relationship therewith, said plunger having a base adapted to retain said combination in an upright position, a crown adapted to fit snugly inside said open lower end of said bottle shell about two inches in diameter and from about one half inch to about one and one half inches thick comprised entirely of a foamed plastic composition, and a trunk located between and connecting said crown and said base having a diameter only slightly less than the diameter of said crown to provide support therefor, said plunger adapted to be moved upwardly inside said open ended bottle shell against the lower portion of said liquid container to force air trapped within said collapsible disposable liquid container out through the nipple on top of said open ended disposable bottle shell to remove substantially all entrapped air inside said collapsible disposable liquid container prior to use by an infant.

2. The anti-burp nursing bottle combination of claim 1 wherein said foamed plastic is foamed polystyrene.

3. A plunger adapted for use in an anti-burp nursing bottle combination having an open ended bottle shell adapted to retain a disposable collapsible liquid container held in place by a ring encircling the top of said shell, said ring also retaining a nipple in place on top of said shell in sealing relationship with said liquid container, said plunger being adatped for insertion in the open lower end of said bottle shell in mating relationship therewith and further being adapted to move upward inside said open ended bottle shell against the lower portion of said liquid container to force air trapped within said collapsible disposable liquid container out through the nipple on the upper portion of said open ended bottle shell to remove substantially all entrapped air inside said collapsible disposable liquid container prior to use by an infant, said plunger comprised of a base, a trunk, and a crown, wherein said crown is in the form of a cylinder adapted to fit snugly inside said open end of said bottle shell about two inches in diameter and about one half to about one and one half inches in height comprised entirely of a foamed plastic composition, said trunk connecting said crown and said base having a diameter only slightly less than the diameter of said crown to provide support therefor, and said base being adapted to maintain said combination in an upright position.

4. The plunger of claim 2 wherein said foamed plastic is foamed polystyrene.

* * * * *